United States Patent [19]

Schöttle

[11] 4,276,824

[45] Jul. 7, 1981

[54] DRIVING AND BRAKING SYSTEM FOR AN ELECTRONIC EMBOSSING MACHINE

[75] Inventor: Helmut A. M. Schöttle, Berlin, Fed. Rep. of Germany

[73] Assignee: Pitney Bowes Deutschland GmbH, Heppenheim, Fed. Rep. of Germany

[21] Appl. No.: 22,014

[22] Filed: Mar. 19, 1979

[30] Foreign Application Priority Data

Mar. 21, 1978 [DE] Fed. Rep. of Germany ..... 2812333

[51] Int. Cl.[3] ..... B41J 1/44

[52] U.S. Cl. ..... 101/18; 101/93.22; 101/99

[58] Field of Search ..... 101/18–21, 101/29, 93.22, 99, 110; 188/71.1, 71.2, 72.1, 73.2, 73.3, 163, 18 A, 218 XL; 192/12 D

[56] References Cited

U.S. PATENT DOCUMENTS

| | | | |
|---|---|---|---|
| 1,301,072 | 4/1919 | Mascord | 101/247 |
| 3,465,862 | 9/1969 | Birdsall | 188/163 X |
| 3,884,144 | 5/1975 | Shimodaira | 101/99 |
| 3,938,436 | 2/1976 | Woodhouse | 101/18 |
| 4,122,770 | 10/1975 | Umeda et al. | 101/99 X |
| 4,170,937 | 10/1979 | Nakagaki et al. | 101/93.22 X |

FOREIGN PATENT DOCUMENTS

| | | |
|---|---|---|
| 863035 | 3/1961 | United Kingdom . |
| 1157757 | 7/1969 | United Kingdom . |
| 1221113 | 2/1971 | United Kingdom . |
| 1336199 | 11/1973 | United Kingdom . |
| 1370269 | 10/1974 | United Kingdom . |
| 1428732 | 3/1976 | United Kingdom . |

*Primary Examiner*—Edward M. Coven

*Attorney, Agent, or Firm*—Peter Vrahotes; William D. Soltow, Jr.; Albert W. Scribner

[57] ABSTRACT

This invention relates to a driving and braking system for an electronically controlled embossing machine of the type having a rotatable drum that carries embossing dies. A drive motor is provided for rotating the drum and a brake is included for stopping the drum in selected embossing positions. The brake includes a disk and a brake lining which are in slight engagement with one another during rotation of the drum so that when the brake is actuated the parts thereof have a small distance to travel.

9 Claims, 5 Drawing Figures

Fig. 2
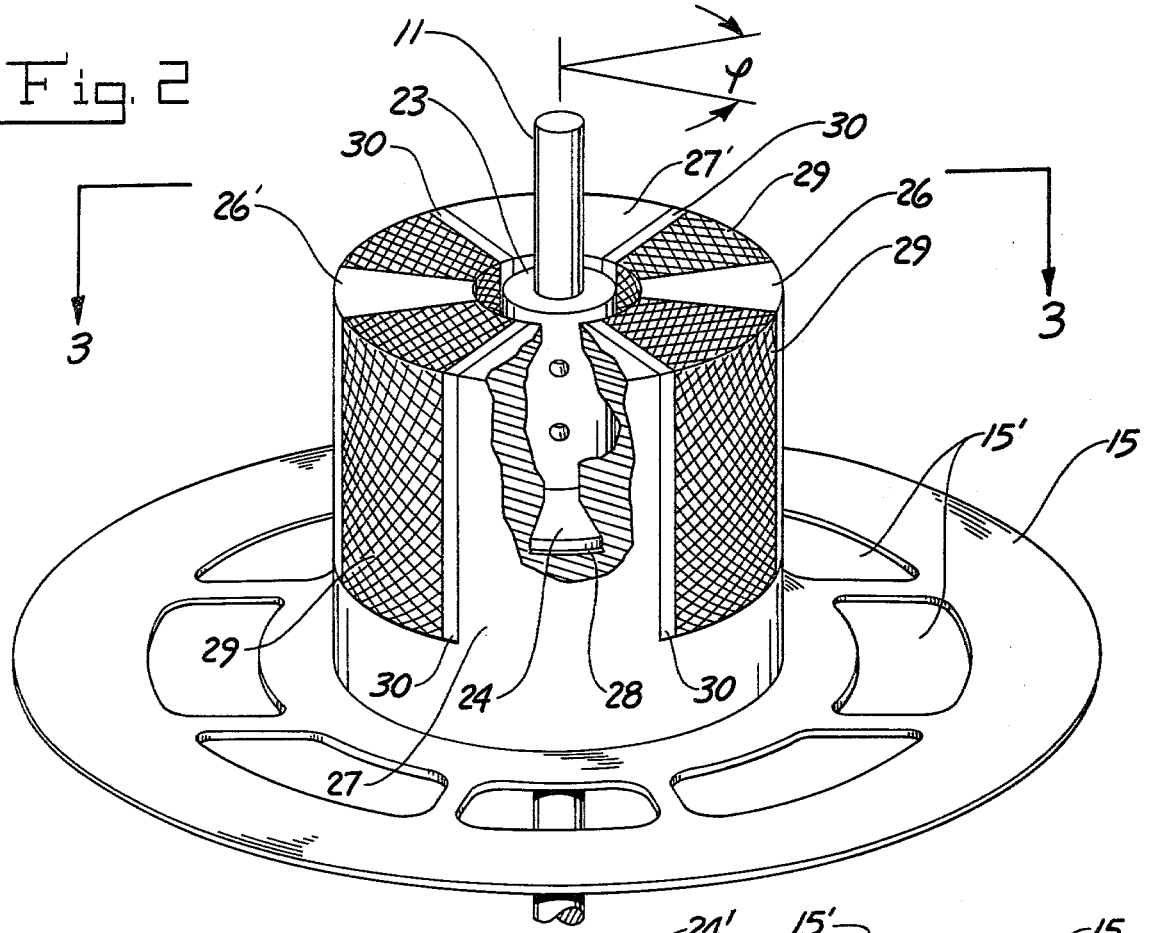
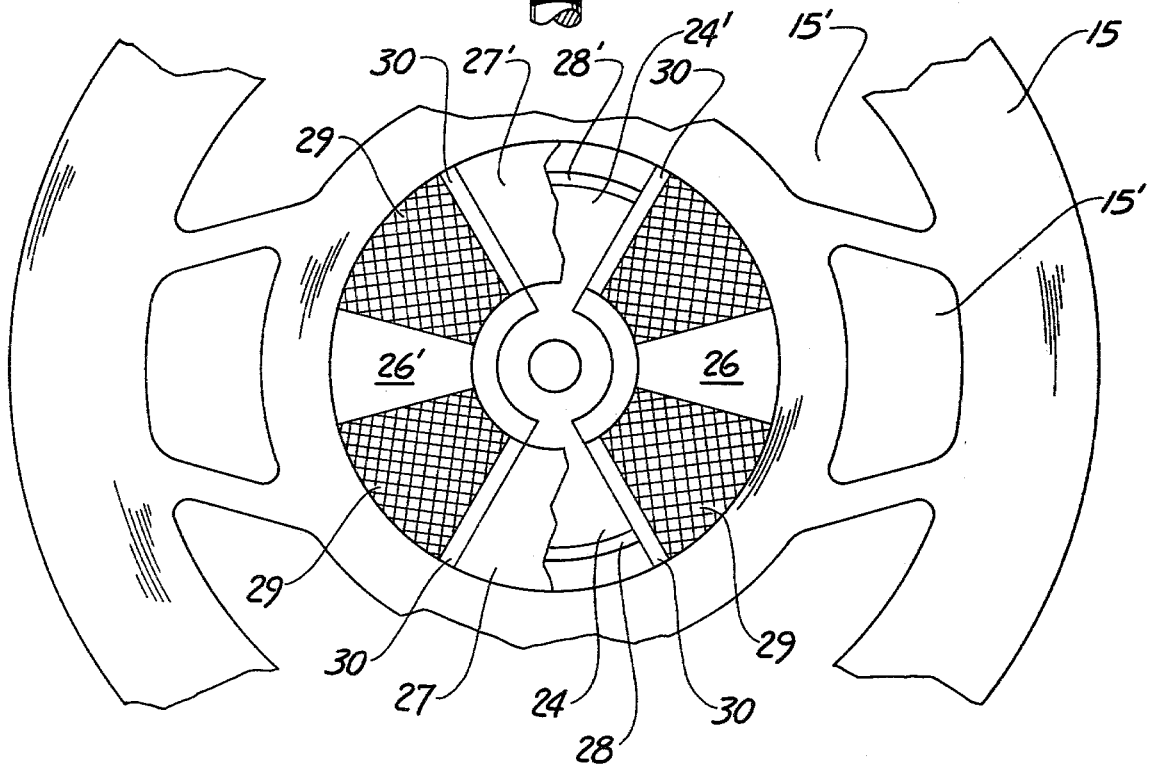
Fig. 3

DRIVING AND BRAKING SYSTEM FOR AN ELECTRONIC EMBOSSING MACHINE

BACKGROUND OF THE INVENTION

Embossing machines are increasingly used for producing identification cards and as a rule they are a part of a complex data processing system which frequently is directly coupled to an electronic data processing device. This occasions the requirements that such an embossing machine be electronically controlled and have a high operating speed.

In embossing machines of the type having a drum-like die head the major part of each cycle of operation is taken up by the time required for angular displacement of the die head to reach a selected position. Consequently, by reducing this setting period the greatest increase in the operating speed can be attained.

In known embossing machines, a reduction of the setting period is obtained by using a stepper motor as the driving motor. However, in order to accelerate and, above all, in order to brake relative heavy masses, a very large stepper motor has to be used. Moreover, a high electrical output is required to operate such a stepper motor. Therefore, because of economic considerations, the attainable increase in operating speed is limited.

Attempts also have been made to directly drive the die head by a direct current motor having a small armature and using the drive motor itself as a brake by means of a counter electromotive force (emf) when the selected position is approached or reached. The operating speed which can be obtained with such a scheme, however, is relatively small because the maximum braking moment is limited by the thermal conditions of the motor armature or the conditions of the commutator. Moreover, the electrical consumption for a system controlled in such a way is relatively large due to the relatively high mechanical time constant if there are oscillations. This would also consume time and would have to be avoided.

SUMMARY OF THE INVENTION

The present invention is concerned with an improved device of the aforementioned kind that will comply with the demands of the user by means of increased speed and with low-noise operation. In a device according to the instant invention the drive motor is a direct current motor with a coreless armature. Using such a drive motor, a maximum acceleration moment is attained if, in the range of its admissible thermal power, it is used exclusively to drive the die head. This requires that an especially efficient braking system be provided for stopping the high speed die head when its selected position is reached. It has been found that an electromagnetic disk brake is particularly suitable for this purpose. In the case where the disk brake is mounted on the shaft of the die drum, which gives an appropriate performance, with such an electromagnetic disk brake, the die drum can be reliably stopped within a short period when the selected position is reached, even at high rotational speed. Therefore, a high operating speed for the setting operation and, consequently, a reduction of the setting period are attained. Moreover, during the operation an extremely low-noise braking of the die drum is attained by using this electromagnetic disk brake. This meets the practical needs because such embossing machines will be used, for instance, in hospitals, clinics or consulting rooms of a medical practioner in order to automatically evaluate the identification means of a health insurance company. So, in such areas, noise reduction is of a considerable importance.

When disk brakes are used, the brake operation itself is nearly noiseless. In the field of application for embossing machines the difficulty resides in that the stopping of a die drum which is provided, for instance, with 96 pairs of dies, must be performed within an angle or rotation of less than 3.75 degrees. This means that for the desired operating speed of the embossing machine (approximately 200 to 300 embossing per minute depending upon the typing speed of an efficient operator) the braking of the die drum will have to be performed in only 1.5 to 2 milliseconds (ms). As a consequence, an actuating element has to be used for the disk brake which is adopted to press the brake lining against the brake disk in this extremely short period and under a pressure of about 1,500 to 2,000 Newton. This can be attained by an electromagnetic braking system according to the invention when the coil of the electromagnet is supplied with a braking impulse of about 50 to 100 times nominal voltage.

The high increase of the magnetic force attained in this manner has the effect that the armature, if this can freely move, will be highly accelerated and, consequently, the pressure plate associated with it which is provided with the brake lining, will strike against the brake disk at high speed when there is only small displacement. Naturally, this would cause a loud noise.

According to the invention, the magnetic driving system for the disk brake is constructed in such a way that the clearance between the armature and the electromagnet is selected to be as small as possible so that the necessary magnetic forces can be attained by a reasonable electrical expenditure (in practice the clearance is about 0.5 mm) and that, moreover, the movable part of the braking system, when in its inactive or home position, is pressed by means of springs which act in the same direction as the magnetic forces, which is the axial direction, against the elastically mounted brake disk so that this also engages a second brake lining under slight pressure.

Consequently, during the setting operation, the die drum is slightly braked, however, this braking is negligible. When the braking impulse is received, an electromagnetic field, with a corresponding magnetic force, is created between the armature and the electromagnet which is transmitted to the brake disk practically without any movement of the armature. If the magnet support has sufficient mechanical rigidity, under the respective forces, springiness will be attained within a range of about 0.02 to 0.03 mm, so that no noticeable noise is formed.

For such an arrangement, it is difficult to apply the brake lining directly to the armature. Therefore, it is suitable to connect the armature through a parallel guide means, which defines a direction of movement perpendicular to the brake disk, to a pressure plate which is provided with the brake lining. Consequently, a considerable higher degree of constructional freedom as to the arrangement of the parts can be obtained. Particularly, a corresponding construction of the parallel guide means enables an independent adjustment of the pressure plate and the armature. Appropriately, moreover, there will be an additional possibility of adjustment for the armature with respect to its position as to the electromagnet and, eventually, the position of the brake lining as to the brake disk can be simultaneously pre-set.

Appropriately, an elastic coupling having high self-damping is arranged between the disk brake and the die drum. Thereby the effective moment at the brake disk is reduced. Moreover, the characteristic frequency of such an elastic coupling or its oscillatory system, respectively, can easily be selected so that the oscillations will have been damped out before the die drum becomes locked in its selected position.

A further reduction of the force to be absorbed by the disk brake and, therewith, an increase in the operating speed or a reduction of the setting period, respectively, can be attained by providing a friction clutch between the drive motor and the die drum. In this case the friction clutch will be adjusted as to a transmission moment which is only slightly more than the maximum moment, i.e. the starting moment of the drive motor. Thus, a considerable component of the kinetic energy of the drive motor will be absorbed by the friction clutch during the braking operation. In such a way the electromagnetic disk brake will be considerably relieved. It has to be emphasized that in practice the moment of inertia of the die drum and that of the drive motor with respect to the die drum can be of the same magnitude. This means, that the double energy would have to be absorbed by the disk brake. However, the constant moment which is transmitted by the friction clutch is only 10% of the braking moment to be applied by the electromagnetic disk brake. Therefore, under otherwise the same conditions, a further increase in the operational speed is attained by the arrangement of said friction clutch between the drive motor and the die drum.

BRIEF DESCRIPTION OF DRAWING

In the drawing an embodiment of the present invention is illustrated, wherein:

FIG. 2 is a perspective view with cut-out portions of an embodiment of an elastic coupling arranged that may be used with the system of FIG. 1 with parts removed for clarity;

FIG. 3 is a partial end view of the embodiment as shown in FIG. 2 taken along the lines 3—3;

DETAILED DESCRIPTION OF THE PREFERRED EMBODIMENT

Figure 1:
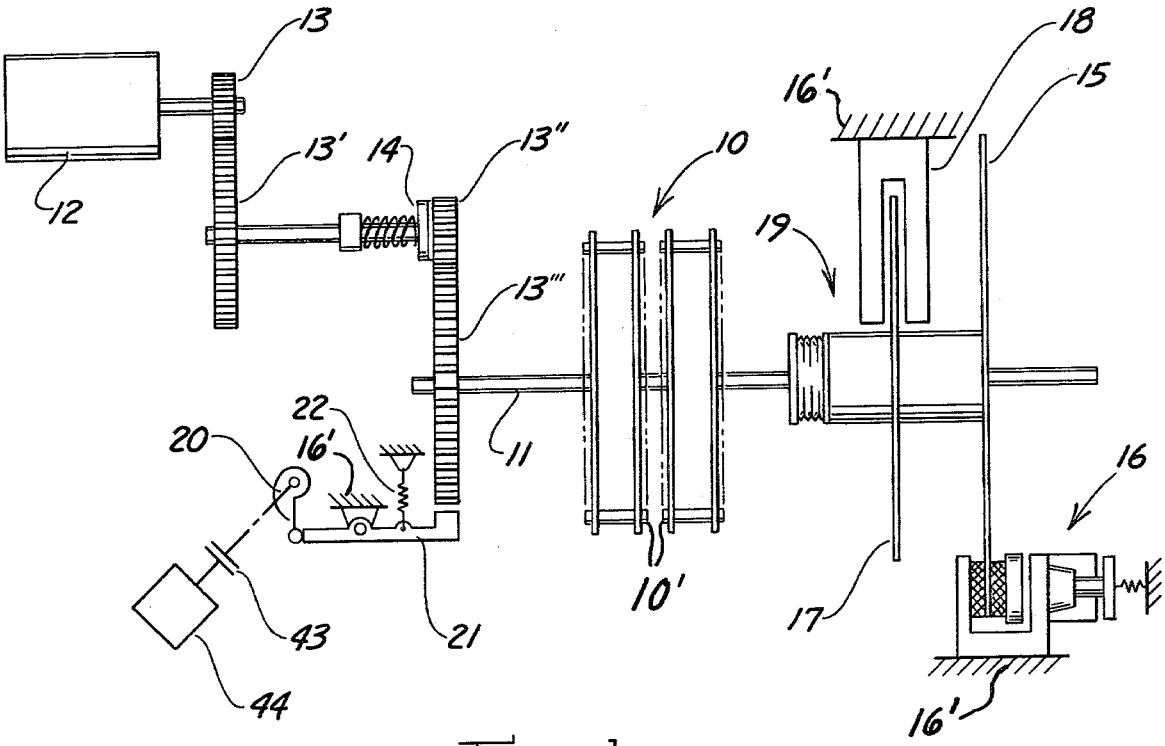
FIG. 1 is a diagramatic view of a driving and braking system for an electronic embossing machine in accordance with the principles of the invention.

Referring to FIG. 1, a die drum 10 of an embossing machine has embossing dies 10' disposed therein and is mounted on a die drum shaft 11. The die drum 10 is driven by a drive motor 12 through two transmission gears 13, 13'. The transmission gears 13, 13' reduce the number of revolutions of the electric motor 12 serving as a drive motor in the ratio of 1:10 because electric motors have their favorable efficiency only when driven at a relative high speed.

As a consequence of this high step down gearing the inertial moment of the motor armature effective at the shaft 11 of the die drum 10 will be multiplied with the square of the gear ratio. This results in considerable difficulty in the braking operation of the die drum 10 when the selected embossing position is reached, thereby increasing the stopping time or stopping distance. A respective reduction of the number of revolutions of the die drum 10, however, again would reduce the operating speed during the setting operation.

Therefore, between the transmission of the force of the drive motor 12 to the die drum 10 through the transmission gears 13, 13', 13'', 13''', a friction clutch 14 is arranged which is only schematically indicated in FIG. 1. This friction clutch 14 is adjusted to a transmission moment that is only slightly more than the maximum moment of the drive motor 12. Thus a considerable component of the kinetic energy of the drive motor 12 is absorbed by the friction clutch 14 when the drive motor is disabled, at which time the friction clutch is actuated. The inertial moment of the drive motor 12 effective at the shaft 11 of the die drum 10, which in the practical operation can reach the magnitude of the inertia moment of the die drum, therefore, will no longer double the to be braked kinetic energy. The constant moment transmitted from the drive motor 12 through the friction clutch 14 to the shaft 11 of the die drum is now only about 10% the braking moment required to stop the die drum 10 at the selected embossing position and which has to be applied by the electromagnetic brake. Thus the drive motor 12 and the die drum 10 can be allowed to have a considerably high number of revolutions per minute (r.p.m.) without any disadvantage with respect to the stopping period.

The brake system comprises a brake disk 15 mounted on the shaft 11 and an electromagnetically actuated brake device 16, in the form of an electric clutch, that is supported by a housing 16'. The electric clutch 16 acts upon the peripheral area of the disk 15 on both sides thereof as will be described more fully hereinafter. The brake disk 15 and the brake device 16 constitute the disk brake. In addition to the brake disk 15, a control disk 17 is mounted at the shaft 11 of the die drum 10. This control disk 17 is used to supply the information relative to the position of the die drum 10 and is scanned by a sensor 18, such as a light sensor, which is attached to the housing 16' and which controls the brake device 16. The control disk 17 has a plurality of radially encoded openings 17' that serve as indicators for the orientation of said die head 10. When the drive motor 12 is started, the die drum 10 will rotate until an electric control of a known kind, as for example shown in German Patent DE-05 No. 2518 590, ascertains at the sensor 18 that the die selected for embossement has arrived at the embossing position. Then an electrical impulse is supplied to the brake device 16, the impulse having as high a power as can be obtained, for instance, by discharging a capacitor with 50 to 100 times nominal voltage of the coil.

Thereby the brake disk 15 of the disk brake will be stopped within about 1.5 ms. Based on the elastic coupling 19 to be described more fully hereinafter, disposed upon the shaft 11 of the die drum between the disk brake and the die drum 10, the die drum can perform only one or two highly dampened oscillations of high characteristic frequency and will then come to rest.

When the electrical impulse is supplied to the brake device 16, simultaneously the motor 12 is disabled the friction clutch 16 is actuated and a one-revolution-clutch 43 of a driver 44, which is shown in FIG. 1, is also actuated. Through this actuation, the driver 44 becomes coupled to a control cam 20 so that a pawl 21 will be released and under the effect of a tension spring 22 will engage a gap between the teeth of the transmission gear 13''' mounted at the shaft 11 of the die drum in order to urge the die drum 10 into the exact embossing position.

Based on the elastic coupling 19 having as high a self-damping as possible and arranged between the die drum 10 and the disk brake, the braking moment is further reduced if the characteristic frequency of the oscillatory system is selected so that oscillations of the part as illustrated in the FIG. 1 on the left side of the elastic coupling 19 will already have been practically damped out when the pawl 21 comes into its engagement position.

FIGS. 2 and 3 illustrate a possible embodiment of the construction of the elastic coupling 19. A driver 23 is fixed to the shaft 11 of the die drum 10. The driver 23 is provided with two radially projecting circular section lugs 24, 24'. The brake disk 15 is fixed to the elastic coupling 19 which comprises two pairs of diametrically opposite noses 26, 26'; 27, 27', being arranged in the nose and axle cross manner, and a buffer medium 29 is inserted in the respective gaps. One of the pairs of diametrically opposite noses 26, 26' is solid, i.e. massive. The second pair of diametrically opposite noses 27, 27' is provided with circular section slots 28, 28'. These slots 28, 28' of the slotted noses 27, 27' receive, with play, projections 24, 24' of a driver 23. The plane of the slots 28, 28', therefore, is perpendicular to the axis of the shaft 11 of the die drum 10. More details will be apparent from the drawing. The buffer medium 29 is made out of an elastic material and pre-stressed to be pressed into the gaps, between the noses 26, 26' or 27, 27' respectively, arranged in a nose and axle cross manner. The buffer medium, therefore, is over-sized.

Furthermore, in order to improve the transmission of force between the projections 24, 24' and the slots 28, 28' of the slotted noses 27, 27' on their sides facing the projections 24, 24', metal plates 30 are fixed to the buffer medium 29. Based on this, the surface pressure is reduced and, moreover, the projections 24, 24' will be prevented from cutting into the elastic material of the buffer means.

Figure 4:
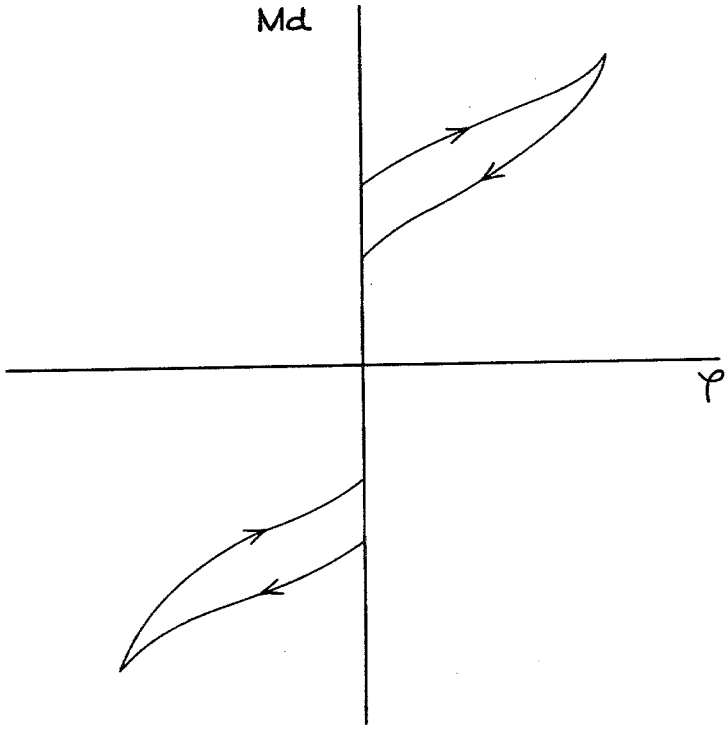
FIG. 4 is a diagram illustrating the characteristic of the elastic coupling shown in FIG. 2.

In FIG. 4 a characteristic of such an elastic coupling is illustrated. As is apparent, in spite of the application of elastomers with a high instrinsic friction, i.e. with a considerable hysteresis between charging and discharging, a very exact rest or zero position can be attained for the clutch and simultaneously a considerable absorbtion of kinetic energy takes place which in turn relieves the disk brake.

The disk brake system comprises the brake disk 15 and an electromagnetic brake device 16. Appropriately, the brake disk 15 is formed very thin and made out of steel and provided with apertures 15' in order to make its rigidity in the axial direction as small as possible.

Figure 5:
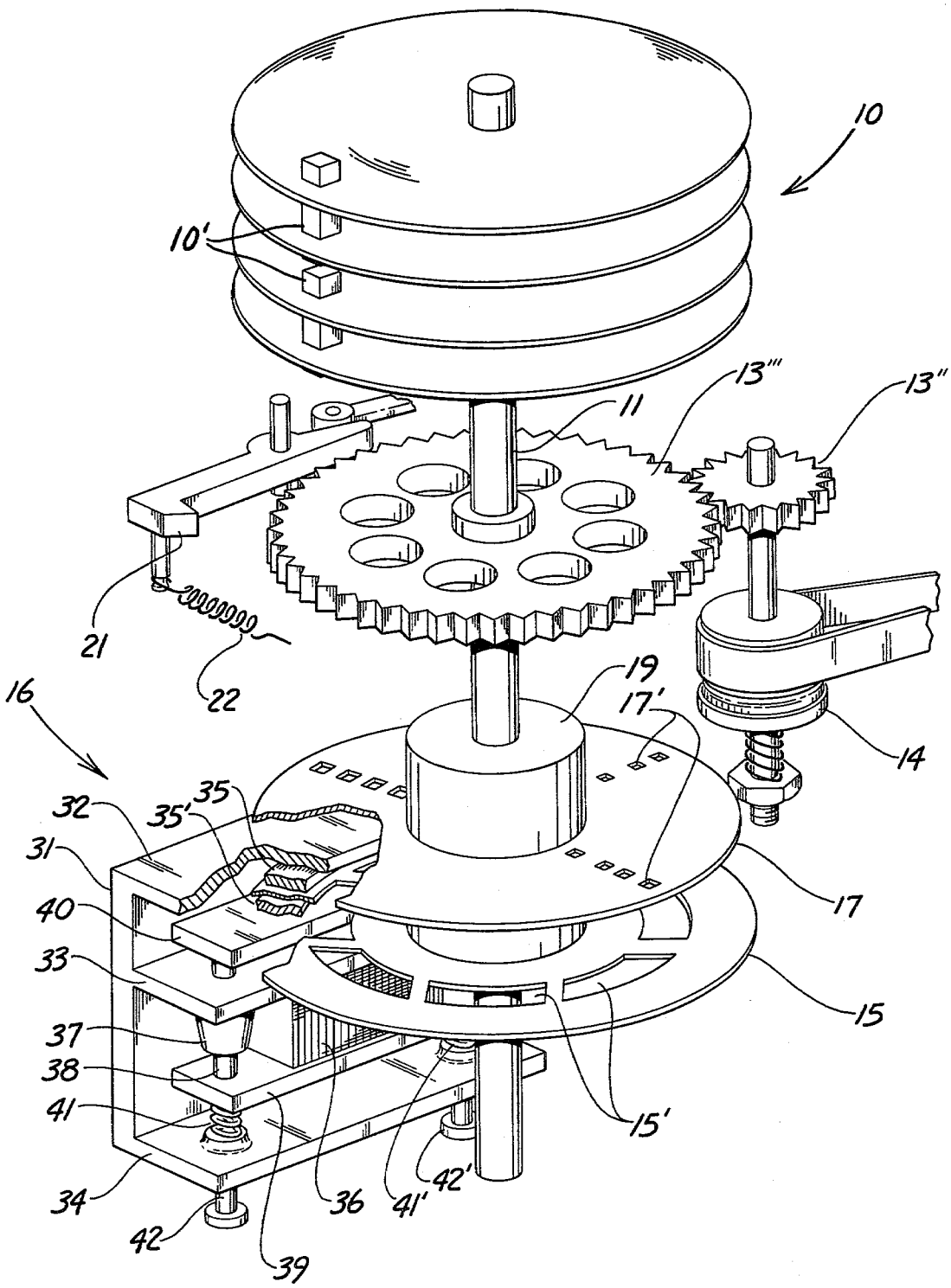
FIG. 5 is a perspective view with cut-out portiions of a braking device for the system of FIG. 1.

Referring now to FIG. 5, the electromagnetic brake device 16 comprises a carrier 31, having, for example, an E-shaped form, which is stationarily mounted on the housing 16', and which is provided with three horizontal arm sections, the upper arm section 32, the middle arm section 33 and the lower arm section 34. The upper arm section 32 receives at its lower surface, which faces the brake disk 15, an upper brake lining 35. The middle arm section 33 carries the electromagnet 36 and is, moreover, provided with the bearings 37 which serve as guides that are disposed upon bars 38 which connect an armature plate 39 mounted opposite the electromagnet 36 with a pressure plate 40 having a brake lining 35' on its surface facing the brake disk 15. The pressure plate 40, therefore, is arranged within the space between the upper and the middle arm sections 32, 33, respectively, and beneath the brake disk 15, which is received therebetween, and it is movable together with the armature 39 in the direction which is perpendicular to the surface of the brake disk and parallel to the axis of the shaft 11 of the die drum 10.

The armature 39 is arranged within the space between the middle and lower arm section 33, 34, respectively, below and in front of the electromagnet 36 which depends from the middle arm section 33. The armature 39 is supported by two pressure springs 41, 41' which extend from the lower arm section 34 in the direction parallel to the axis of the die drum shaft 11.

The carrier 31 is mounted on the housing 16' and is adjustable so that the upper brake lining 35 is in sliding contact, with a slight pressure, with the brake disk 15. Subsequently, the armature 39 is lifted by means of the adjustment screws 42, 42' through pressure springs 41, 41' so that the lower brake lining 35' is also in sliding contact with the brake disk 15 under slight pressure. Both the brake linings 35 and 35', therefore, are slightly engaged, with slight pressure, with the brake disk 15. This insignificant permanent braking of the die drum 10, however, will be neglectible during operation.

During the adjustment of the adjustment screws 42, 42', the armature 39 simultaneously approaches the electromagnet 36 and will be advanced until only a small clearance, such as 0.5 mm or less, remains. Thus, the armature 39 will already be directly in front of the magnetic coil and virtually does not move when the braking impulse arrives and, therefore, no impact noise will be caused. The remaining small amplitude of movement, however, will be sufficient to increase the pressure of the brake linings 35, 35' to the brake disk 15 and, therefore, to obtain the braking effect.

The distance of the armature 39 to the pressure plate 40 can, eventually, be adjusted by means of a change of the length of the bars 38, so that the slight engagement of the brake lining 35' at the brake disk 15 and simultaneously the arrangement of the armature 39 directly in front of the electromagnet 36 will reliably be ensured.

Therefore, a very high r.p.m. of the die drum 10, and thereby, a respective high setting speed is possible without any danger than the exact embossing position might be affected. By using the efficient disk brake comprising the brake disk 15 and the brake device 16, a speedy stopping at the embossing position is assured also for a high number of revolutions per minute and this operation also will be enhanced by action of the friction clutch 14 and the elastic clutch 19. A driving and braking system of the proposed system will cause only low noise.

What is claimed is:

1. Driving and braking apparatus for an electronic embossing machine, comprising: a housing, a shaft rotatably disposed within said housing, a die drum having a plurality of embossing dies mounted on said shaft, a drive motor, means for drivingly engaging said motor and said shaft, a control disk having location sensing means at the perimeter thereof mounted on said shaft, a sensor located to receive a portion of said control disk and a brake means for braking the die drum including an elastic coupling mounted on said shaft, a brake disk supported by said elastic coupling, and an electric clutch supported by said housing, said brake disk being brakingly engageable by said electric clutch.

2. The apparatus of claim 1 including a friction clutch supported within said housing and means for brakingly engaging said friction clutch and said driving engagement means when said electric clutch is enabled.

3. The apparatus of claim 2, including a pawl supported within said housing and means for driving said pawl into engagement with said braking engagement means when said electric clutch is enabled in order to urge the die drum into a selected position.

4. The apparatus of claim 1, wherein said brake means includes an elastic coupling mounted on said shaft, said brake disk being mounted on said elastic coupling.

5. Driving and braking apparatus for an electronic embossing machine, comprising: a housing, a shaft rotatably disposed within said housing, a die drum mounted on said shaft, said die drum having a plurality of embossing dies mounted thereon, means for rotatably driving said shaft, a control disk having location indicators mounted on said shaft, a sensor located to recieve a portion of said control disk, a brake disk mounted on said shaft, a carrier supported by said housing and having first and second arms extending therefrom, said first and second arms being spaced from one another, said brake disk having a portion of its perimeter area received between said arms, the first of said arms having a brake lining on its surface addressing said brake disk, an electromagnet mounted on a surface of said second arm movingly supported by said carrier, an armature adjacent to said electromagnet, a plate supported by said armature intermediate said brake disk and said second arm and a brake lining supported upon said plate on a surface addressing said brake disk, said plate brake lining being opposed to said first arm brake lining, said brake linings being in sliding contact with said braking disk when said electromagnet is disabled and said armature engages said electromagnet when said electromagnetic is enabled to cause said brake linings to be driven toward one another to brakingly engage said brake disk.

6. The apparatus of claim 5, including a friction clutch supported within said housing and means for brakingly engaging said friction clutch with said means for driving said shaft when said electromagnet is enabled.

7. The apparatus of claim 6, including a pawl supported within said housing and means for driving said pawl into engagement with said means for driving said shaft when said electromagnet is enabled in order to urge the die drum into a selected position.

8. The apparatus of claim 5, wherein said brake means includes an elastic coupling mounted on said shaft, said brake disk being mounted on said elastic coupling.

9. The apparatus of claim 8, wherein a cylinder is fixed to the brake disk which comprises four semi-circular sections arranged as opposite pairs, one pair of said semi-circular sections having slots in a plane which is perpendicular to said shaft, a driver fixed to said shaft and mounted within said slots, and elastic buffer material inserted in a press fit between said semi-circular sections.

* * * * *